US005168940A

United States Patent [19]

Foppe

[11] Patent Number: 5,168,940

[45] Date of Patent: Dec. 8, 1992

[54] PROFILE MELTING-DRILL PROCESS AND DEVICE

[75] Inventor: Werner Foppe, Geilenkirchen, Fed. Rep. of Germany

[73] Assignee: Technologie Transfer Est., Schaan, Liechtenstein

[21] Appl. No.: 658,104

[22] Filed: Feb. 20, 1991

Related U.S. Application Data

[63] Continuation-in-part of Ser. No. 275,090, Nov. 21, 1988, Pat. No. 5,107,936.

[30] Foreign Application Priority Data

Jan. 22, 1987 [DE] Fed. Rep. of Germany ..... 3701676
Jan. 12, 1988 [DE] Fed. Rep. of Germany .....PCT/DE88/00013

[51] Int. Cl.[5] ..... E21B 7/14; E21C 37/16
[52] U.S. Cl. ..... 175/11; 299/14
[58] Field of Search ..... 299/14; 175/11, 16, 175/17; 125/2; 241/1; 225/93.5

[56] References Cited

U.S. PATENT DOCUMENTS 914,636 3/1909 Case ..... 299/14 X
4,304,308 12/1981 Munding et al. ..... 299/14

FOREIGN PATENT DOCUMENTS 2554101 1/1986 Fed. Rep. of Germany .
1023054 6/1983 U.S.S.R. ..... 175/17
90/13729 11/1990 World Int. Prop. O. .

OTHER PUBLICATIONS

Los Alamos Scientific Laboratory Report "Rock Melting as a Drilling Technique" Mar. 1965.

*Primary Examiner*—David J. Bagnell
*Attorney, Agent, or Firm*—Horst M. Kasper

[57] ABSTRACT

Only a gap defining the outer profile of the tunnel or borehole is melted down in a peripheral heat drilling process for tunnels, deep-well and exploration boreholes. The drill core, surrounded by the generated gap, initially remains and is then extracted at intervals via a tube. It is expedient for the drill core to be sheared off and extracted continuously after it has passed a cooling zone. The height of the drill core, which first remains in the borehole, is determined such that the molten rock can be pressed into the drill core, whereby the necessary pressure for this pressing in is maintained essentially constant, independently of the depth of the borehole concerned.

28 Claims, 7 Drawing Sheets

PROFILE MELTING-DRILL PROCESS AND DEVICE

CROSS-REFERENCE TO RELATED APPLICATIONS

This application is a continuation-in-part application of another application filed Nov. 21, 1988 and bearing Ser. No. 07/275,090, now U.S. Pat. No. 5,107,936. The entire disclosure of this latter application, including the drawings thereof, is hereby incorporated in this application as if fully set forth herein.

BACKGROUND OF THE INVENTION

1. Field of the Invention

The invention relates to a heat drilling process for the drilling of tunnels, deep wells, and exploration boreholes, wherein the profile of the tunnel or borehole is melted by means of a heat source and wherein the resulting molten rock is pressed out during the drilling process.

2. Brief Description of the Background of the Invention Including Prior Art

A full melting-drill method as taught in German Patent DE-PS-2,554,101 is concerned with the melting of rocks under pressure with hydrogen-oxygen mixtures as combustion fuel gases and to the pressing of a resultant fused rock mass into the sidewall rock with the aid of the so-called "Litho-Frac Mechanism" which works in the resultant rock melt like the well-known "Hydro-Frac Mechanism" in pressed water, applied in oil field revival.

Melting-drill methods of the Los Alamos Scientific Laboratory, USA, performed before the process according to German Patent DE-PS 2,554,101, were carried out according to this principle. However, in the case of the Los Alamos Scientific Laboratory process, the melt energy was drawn from an energy source disposed in the drilling device, namely from a core reactor or from an arc. The heat generated there was then transmitted via heat pipes to the melt head of the drilling device. The temperature present in the melt head melted the rock mass. In this form of indirect energy transmission onto the rock mass to be melted, the level of the appliable melt temperature is limited, on the one hand, by the energy sources themselves and, on the other hand, by the thermal loading capacity of the melt-head material. German Patent document DE-PS 2,554,101 further developed the process by one large step in that an oxyhydrogen gas flame, formed by a stoichiometric combustion of hydrogen and oxygen, serves as heat source which, with its heat of over 3,000° C., acts directly on the rock mass and melts the rock mass. The drill head itself only feeds the fuel gases and the temperature of the drill head can thus be maintained at a lower temperature by several hundred degrees celsius by means of inner cooling. The thermal load of the drill head is thus markedly reduced and its service life is correspondingly increased. In principle, the melt process operates such that the rock mass is melted in the immediate proximity of the heat source by means of heat application. Due to the enormous temperature gradients relative to the neighboring rock mass, cracks are formed in the neighboring rock mass by the tremendous temperature stresses. This procedure is a so-called thermofraction procedure. In the melting-drill process, regardless of the type of heat source used, the resulting melt and fused rock mass is continuously pressed into the cracked rock mass in that the resulting cracks are enlarged under high pressure. This procedure is called Litho-Frac.

According to the melting-drill method of the German Patent DE 2,554,101, the pressure of the hydrogen-oxygen combustion fuel gases has to be increased with increasing borehole depth, since the shearing forces in the sidewall rock increase proportionally to the depth, based on the increasing overburden pressure in the sidewall rock. Therefore, higher pressures have to be created in the melted mass in the context of the "Litho-Frac"-mechanism, in order to be able to crack open the surrounding rock and in order to allow the excess melted rock mass to flow off into the cracks of the surrounding rock. This method cannot be continued where the limit of the technically acceptable pressure generation is reached in the combustible gas mixture during operation.

This melting-drill method of total displacement of drill core fused mass into the sidewall rock comes to a stop if, as depth increases, the equally increasing shearing forces of the sidewall rock rise to the value of the pressure in the combustible gases which can technically be achieved in practice. As the melt drill apparatus advances, the pressure in the fused mass can no longer overcome the shearing forces of the sidewall rock and so becomes greater than the pressure in the combustible gases.

SUMMARY OF THE INVENTION

1. Purposes of the Invention

It is an object of the present invention to provide for a melting-drill process where, with technically controllable combustion pressures, a continuation of the drilling is made possible to such depths where the shearing forces of the surrounding sidewall rock are of such a magnitude that the combustion pressure is no longer sufficient for an enlargement of the cracks present in the sidewall rock.

It is a further object of the invention to provide for a melting-drill process where the grouting of the resultant melt is possible independent of the shearing forces in the surrounding sidewall rock and thus independent of the borehole depth.

It is yet a further object of the present invention to provide for a melting-drill process, where a drilling is no longer limited because after exceeding of a certain diameter size a melting of the full drill core diameter is no longer possible and because of energetic and process-technical conditions. The invention melting-drill process enables a construction of boreholes having a diameter of up to several meters and is associated with less energy consumption, less material expenditure, and less time expenditure.

It is yet another object of the present invention to provide for a device for the performance of the invention process.

These and other objects and advantages of the present invention will become evident from the description which follows.

2. Brief Description of the Invention

In the profile melting-drill method according to the invention, a so-called peripheral melting-drill process is used.

In contrast to the full melting-drill method taught in the German Patent document DE-PS 2,554,101, where the full cross-section of the drill core is melted and thus the total resulting melt has to be pressed into the sidewall rock, according to the profile melting-drill method of the present invention, the overburden pressure in the region of the drill core is decreased based on the section-wise removal of the drill core such that the pressing of the resulting molten mass is changed from the outer profile of the bore to the borehole and drill core. Thus, in spite of an increasing drilling depth, the drilling can be performed at substantially uniform and unchanged hydrogen/oxygen pressures in the molten fused rock mass, since the shearing forces in the drill core region are maintained low.

The limitation of the melting-drill method of total displacement of borehole fused rock mass into the side wall of the borehole is overcome by the invention profile melting-drill method, in that the profile melting-drill method melts and fuses only the outer profile of the borehole, and a core which stays behind is removed in sections through a central pipe in the drill device. Because of the consequently reduced shearing forces in the drill-core area, as compared to those of the adjoining sidewall rock, the fused mass from the borehole profile is not pressed into the sidewall rock with the exception of any naturally occurring cracks in the surrounding rock, but rather into the drill core area.

The invention melting-drill method eliminates the factors hampering the present drilling technique, such as frequent drill-head changes with round-trip stringing, removal of well cuttings by flushing, cement casing of borehole walls, borehole side-tracking, tensile strength of drill-string material, progressive increase in drilling time with increasing depth and rock temperature.

A melting-drill process for tunnel drillings, deep-drillings, and exploratory drillings comprises the following steps. A drill core is detached from its rock formation mass under cracking and ripping caused by thermal stresses. Only a profile of a borehole to be drilled is melted. The resulting melt is substantially pressed into the drill core. The drill core is subsequently solidified by cooling. The drill core is sheared off and removed in sections. A pressure decrease is thereby achieved in drillings. Said pressure decrease allows a limiting of the required melt pressure in the drilled hole.

The drilling can be performed to depths, where the overburden pressure in the sidewall rock exceeds the technically controllable melt pressures such that the melt can no longer be pressed into the sidewall rock. The drilling can be performed for shaft and tunnel drillings which run in a vertical direction and where oversized diameters do not allow a removal of the drill core melt due to energy and process-technical reasons.

The weight proper of the drill core can be used for a generation of a counter pressure relative to the melt pressure. The drill core can be kept at a roughly permanent height level by a continuous shearing off and removal of the drill core. The roughly permanent height level of the drill core allows a drill advance under a roughly constant melt pressure.

The melting can be performed by at least one high-temperature source supplied by a stoichiometric combustion of hydrogen and oxygen, by laser canons, by ionized plasma rays, by electron gun beams, or by an electric arc.

The device for executing a melting-drill process for tunnel drillings, deep-drillings, and exploratory drillings comprises a hollow-cylindrical pressure pipe strand. A hollow-cylindrical pressure drill head for melt drilling is attached to the hollow-cylindrical pressure pipe strand. A space in the center of the pressure drill head and of the pressure pipe strand is left empty in direction of drilling.

Several heat sources can be distributed over the circumference of the hollow-cylindrical pressure drill head. Said heat sources can generate the melt heat. A tubular cooling zone can include a wall. The hollow-cylindrical pressure drill head can taper in an upward direction at its inner side and opens into a tubular cooling zone. A cooling agent can flow through the wall of the cooling zone.

A steel pipe, having a slightly larger inner diameter than the cooling zone, can follow the cooling zone of the hollow-cylindrical pressure drill head. Preferably, the steel pipe is to act as support pipe over the height of a retained drill core column. Two steel pipes can be disposed concentrically with respect to each other. The two steel pipes can each be assembled by at least two shells. There can be provided one fuel line for liquid oxygen, one fuel line for liquid hydrogen, and a cooling line for a cooling medium. The two steel pipes can form the pressure pipe strand. The fuel lines and cooling line can be guided in an intermediate space between the two steel pipes.

A drill-core hoisting device can be suspended in the interior of the pressure pipe strand. The drill-core hoisting device can be formed as a bell which can be clapped over a remaining drill core. The bell-shaped drill core hoisting device can include a lower part and an upper part. Means for clamping and shearing off of a drill core can be disposed at the drill core hoisting device. The means for clamping and shearing off of the drill core can be furnished by hydraulic or pneumatic piston cylinder units.

The lower part of the bell-shaped drill-core hoisting device can be formed flexible such that the upper part of the bell-shaped drill-core hoisting device can be tilted in relation to said lower part of the bell-shaped drill core hoisting device.

A closure means can be disposed at the lower part of the bell-shaped hoisting device. Said closure means can close off the lower part of the bell-shaped hoisting device.

Catch pockets can be disposed above the closure means of the hoisting device. Rocks, broken off during the shearing off, can be transported with conveying means into the catch pockets by means of compressed air.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The accompanying drawings show several of the various possible embodiments of the present invention.

DESCRIPTION OF INVENTION AND PREFERRED EMBODIMENT

Figure 1:
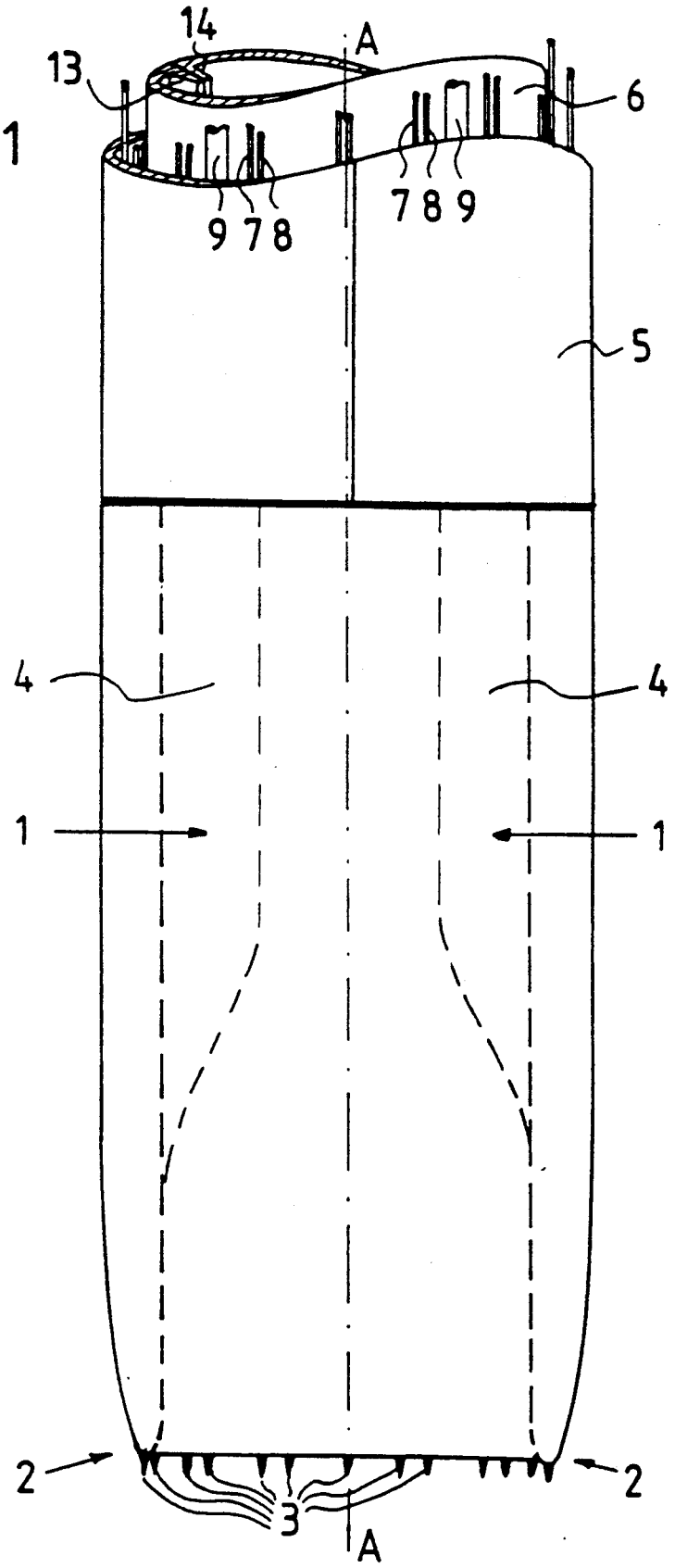
FIG. 1 is a side view of a drill apparatus for performing the invention profile melting-drill process.

According to the present invention, there is provided for a melting-drill process for tunnel drillings, deep-drillings, and exploratory drillings to drill depths where the overburden pressure in the sidewall rock exceeds the technically controllable melt pressures such that the melt can no longer be pressed into the sidewall rock, or for shaft and tunnel drillings which run in a vertical direction, where oversized diameters do not allow a removal displacement of the total drill core melt due to energy and process-technical reasons. Only an outer circular profile of the borehole to be drilled is melted. The resulting melt 11 is primarily pressed into the drill core 12, which has been detached from its rock mass 10 and is therefore cracked and ripped by thermostress. The drill core 12 is subsequently solidified by cooling. The drill core 12 is sheared off and removed in sections, whereby a pressure decrease is achieved in shaft drillings and deep-drillings, where said pressure decrease allows a limiting of the required melt pressure.

The weight of the drill core 12 itself can be used for a generation of a pressure counter to the melt pressure in that the drill core 12 is left in place at a nearly permanent height level due to a continuous shearing off and removal. The nearly permanent height level of the drill core 12 allows an advance under a nearly constant melt pressure.

The melting can be performed by at least one high-temperature source supplied by a stoichiometric combustion of hydrogen and oxygen, by laser canons, by ionized plasma rays, by electron gun beams, or by an electric arc.

The device for execution a melting-drill process for tunnel drillings, deep-drillings, and exploratory drillings comprises a hollow-cylindrical pressure drill head 1 for melt drilling and a hollow-cylindrical pressure pipe strand. A space in the center of the pressure drill head 1 and of the pressure pipe strand is left empty in direction of drilling. Several heat sources are distributed over the circumference of the hollow-cylindrical pressure drill head 1. Said heat sources generate the melt heat. The hollow-cylindrical pressure drill head 1 is upwardly tapered at its inner side and opens into a tubular cooling zone 4. A cooling cooling agent can flow through the wall of the cooling zone 4. A steel pipe 19 of a slightly larger inner diameter than the cooling zone 4 follows the cooling zone 4 of the hollow-cylindrical pressure drill head 1. The steel pipe 19 forms a support pipe over the height of the remaining drill core column. The pressure pipe strand is comprised of two steel pipes 5, 6, disposed concentrically with respect to each other. The two steel pipes 5, 6 are each assembled by at least two shells. Lines 7, 8, 9 for a supply of fuel gas and cooling agent are guided in an intermediate space between the two steel pipes 5, 6. A drill-core hoisting device is suspended in the interior of the pressure pipe strand. The drill-core hoisting device is formed as a bell which can be clapped over the remaining drill core 12. The drill-core hoisting device includes means 24–28 for a clamping and shearing off of the drill core 12.

The means for clamping and shearing off of the drill core 12 can be disposed at the drill-core hoisting device and can be furnished by hydraulic or pneumatic piston cylinder units 24–28.

A lower part of the bell of the drill-core hoisting device can be formed flexible such that the upper part of the bell can be tilted in relation to the lower part of the bell. The lower part of the bell of the hoisting device can be closed off by means of a diaphragm 32. Catch pockets can be disposed above the diaphragm 32 of the bell. Means can be provided for a transporting of broken rocks, produced during the shearing off, into the catch pockets by means of compressed air.

An exemplified embodiment of the drill apparatus is shown in FIG. 1 in a side view. The drill apparatus comprises a peripheral profile pressure drill head 1, formed substantially like a hollow cylinder. Nozzles 3 are distributed over the circumference of the lower end 2 of the pressure drill head 1. The pressure drill head 1 is provided with an internal cooling system. The peripheral, annular pressure drill head 1 can have an annular width of, for example, 10 cm in case the drill apparatus exhibits an overall diameter of, for example, 100 cm.

The pressure drill head 1 is preferably made out of a raw material where the essential components are zirconium boride, tungsten, titanium diboride, zirconium carbide, and molybdenum. The raw material of the pressure drill head 1 can be structured such that the pressure drill head 1 acts like a metal on the cooled inner side and acts like a high-temperature-resisting, melt-repellent ceramic on the thermally loaded outer side. The material of the pressure drill head acts in the interior of such a pressure drill head 1 like a ceramic-metal mixture. Ceramic and metal complement each other in this way in an ideal manner, since ceramic is a very hard and wear-resistant material, which withstands high temperatures and is moreover melt-resistant and melt-repellent. These factors reduce a corrosion effect on the surface of the pressure drill head 1 and the adhesion force of said surface in relation to the liquid rock melt. However, the thermal conductivity of ceramic is very low. In contrast, metal exhibits a high tensile strength and a good thermal conductivity, whereby the efficiency of the cooling unit, acting from the inside, is increased.

Two fuel gas lines 7, 8 for each nozzle 3 are disposed at the inside of the pressure drill head 1. The fuel gas line 7 is for liquid hydrogen and the fuel gas line 8 is for liquid oxygen. The fuel gas lines 7, 8 open at the annular lower end 2 of the pressure drill head 1, such that the exiting fuel gases cause a stoichiometric combustion there while producing oxyhydrogen flames at the nozzles 3. The radial thickness of the annular lower end section of the pressure drill head can be from about 0.1 to 0.5 times the radius of the pressure drill head and is preferably from about 0.2 to 0.3 of the radius of the pressure drill head. The axial length of the lower end section can be from about one to two times the diameter of the pressure drill head. Aside from the cooling effect which the fuel gas lines 7, 8 already have exert on the pressure drill head 1, cooling lines can furthermore pass through the inner side of the pressure drill head 1. These cooling lines can for example carry water under high pressure, which assists in the discharge of melt heat and in maintaining the material of the pressure drill head 1 at a low temperature.

Somewhat displaced from the lower end 2 of the pressure drill head 1, the pressure drill head 1 is tapered upwardly at its inner side and ends in a tubular cooling zone 4. The inner diameter of the tubular cooling zone can be about 0.3 to 0.5 times the diameter of the drill head and preferably 0.35 to 0.45 times the outer diameter of the drill head. A cooling agent can flow through the wall of the cooling zone 4. The inner wall of the cooling zone 4 is shown with dashed lines in FIG. 1. The inner diameter of this cooling zone 4 amounts to from about ⅓ to ½ of the drill device diameter. According to the invention process, the thus formed hollow cylinder, having a reduced inner diameter acts both as a cooling zone and as a profiler generator for the drill core, as further described below with reference to FIG. 2.

The pressure pipe strand is disposed above the pressure drill head 1. The pressure pipe strand is essentially formed by an outer steel pipe 5 and by an inner steel pipe 6. The fuel gas lines 7, 8 and the cooling lines 9 for the cooling medium, which is preferably water, are guided in the intermediate space between the outer steel pipe 5 and the inner steel pipe 6. Since the invention drill process operates continuously, i.e. one operates in with one steady and constant drill advance to the targeted drill depth, the lines 7, 8, 9 are advantageously formed as endless lines over the complete drill depth for the maintenance of a constant pressure. During the drill advance, the pressure pipe strand must therefore be assembled by segments around the continuously fed lines 7, 8, 9. For this purpose, the outer steel pipe 5 as well as the inner steel pipe 6 are formed in each case by two half-shells. These half-shells can be assembled to form the corresponding pipes 5, 6.

In order to apply at all times a determined feed pressure to the fully assembled pressure pipe strand, hydraulic pressure transducers can for example be provided above ground. Said feed pressure then acts on the drill device. Corresponding processes and devices for carrying out the continuous melting-drill process are described in the international application PCT/CH90/00123 and do not form a part of the instant invention.

Figure 2:
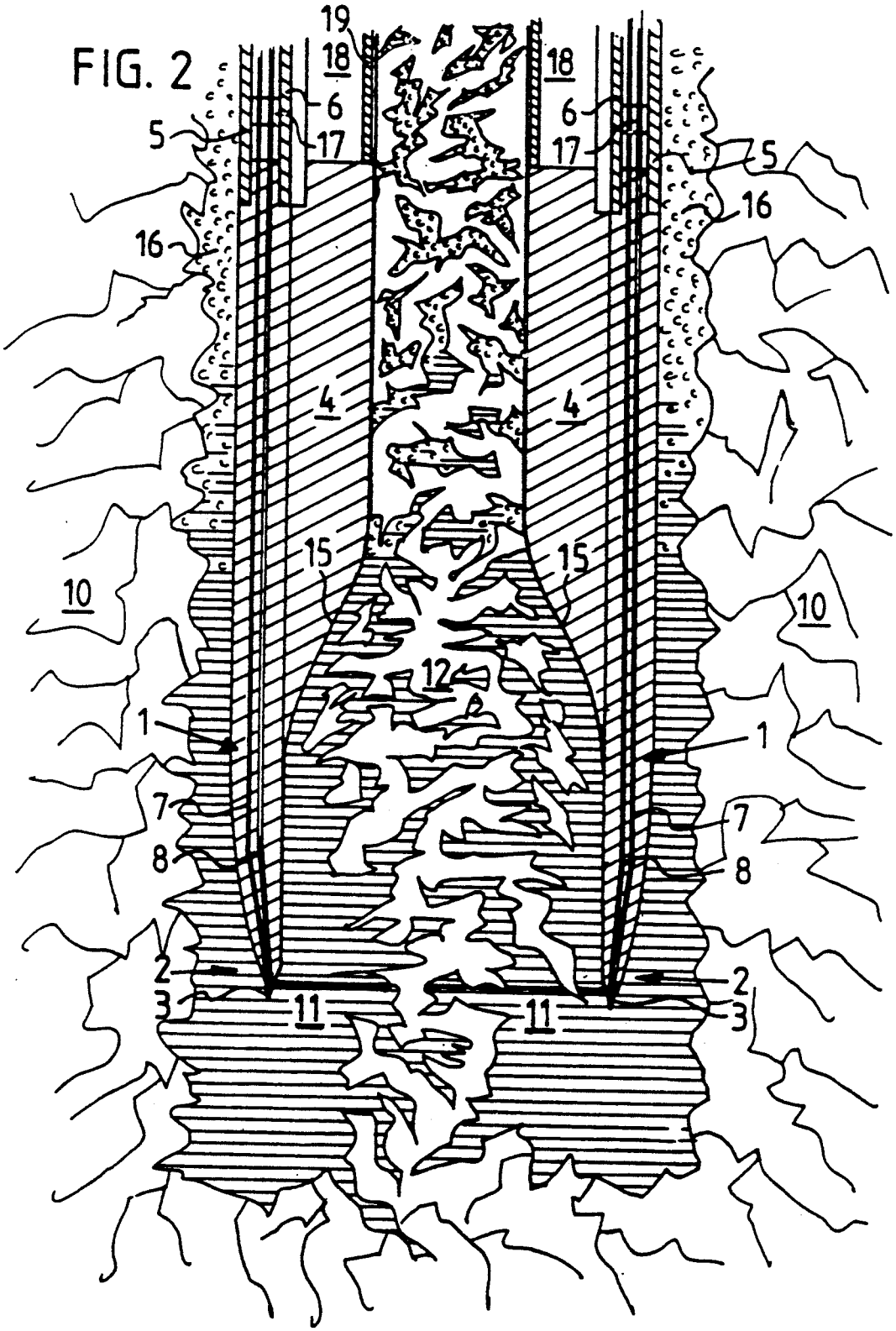
FIG. 2 is a view of a schematic representation of the drill apparatus during operation, and in fact as viewed from the side in a sectional representation along section line 2—2 of FIG. 1.

FIG. 2 illustrates the drill apparatus according to FIG. 1 under operation conditions, and in fact in a schematic sectional view along section line 2—2 of FIG. 1. The pressure drill head, illustrated in FIG. 2, has already reached deep into the rock mass 10, namely into a region where the shearing forces in the sidewall rock mass 10 are larger than the forces generated by the fuel gas pressure employed. Cracks are formed in the sidewall rock mass 10 as a result of thermofraction. However, due to a reaching of the technological fuel gas pressure limitation, no fused and molten rock mass could be pressed into these cracks and an enlargement of the cracks with Lithofrac remains therefore excluded. At this point, all conventional melt drill processes come to a standstill, since the resulting melt mass can no longer be removed.

According to the invention profile melting-drill process, only the profile is melted, i.e. an annular ring having an outer diameter of the size of the desired borehole, is melted, whereas the region within this annular ring is left in place. The width of the annular ring is decisively determined by the dimensions of the aggregates required for the melt drilling and carried along with the drill apparatus itself, as well as by the requirement that the remaining core has to be sheared off, hoisted and removed from time to time. The narrower the annular ring can be kept, the lower the amount of melt energy required.

A cross-section through the pressure drill head 1 with the fuel gas lines 7, 8 guided in the pressure drill head 1 is shown in FIG. 2. The fuel gas lines 7, 8 lead to the parabolically tapered lower end 2 of the crown of the pressure drill head 1. The fuel gases, hydrogen and oxygen, subjected to high pressure and exiting at the nozzles present at the crown of the pressure drill head 1, are stoichiometrically combusted in oxyhydrogen flames at the nozzles 3. A temperature peak of about 3,500° C. is reached in the oxyhydrogen flames at the nozzles 3, at which temperature the rock mass melts. The melted rock mass, i.e. the melt or fused mass 11, is shown in FIG. 2 with horizontal lines. Since a drill core 12, left in place in the center, is continuously removed and transported upwardly until the illustrated situation is achieved, a relatively low rock-mass pressure is exerted onto the drill core 12. As soon as the drill core 12 is broken off from the rock formation of the surrounding rock mass 10 by the melting of the profile, defined by the pressure drill head 1, the drill core 12 is also freed from the enormous rock-mass pressure existing there. The remaining drill core 12 cracks and bursts without fail based not only on thermofraction but also on breaking the drill core 12 off from its rock formation.

Based on the relatively low pressure of several hundred bars present in the melt, the melt advances at once into the cracks formed in the drill core 12, enlarges said cracks, and fills in completely said cracks. The drill core 12 thereby experiences an upward growth. The parts of the drill core 12, which are unmarked and left white in FIG. 2, represent the broken rock parts which have remained solid, whereas the hatched parts of the drill core 12 represent the penetrated or flown in melt 11 or, respectively, the melt permeating the drill core 12.

Upon further advance of the drill apparatus, the drill core 12 is pressed upwardly through the tapered part of the pressure drill head 1, which also acts as cooling zone 4. This upward pressing action is similar to dispensing tooth paste from a tube. The cooling zone 4 is formed as a funnel 15 in its lower region in that its inner diameter is continually increased to the dimension of the outer diameter of the core. The cooling zone 4 thereby also acts as a profile generator for the drill core 12 in that it determines the diameter of the drill core 12. The smaller the diameter of the drill core, the faster the drill core grows upwardly in length upon advance of the drill apparatus. In a certain section of the advance, the volume of the drill core corresponds to the volume of the melt, displaced in each section by the drill device, and the volume of a drill core having the length of the advance.

Moreover, the cooling zone 4 is passed through moreover by cooling pipe conduits, preferably water-conducting cooling pipes, not shown. The cooling medium removes so much melt heat from the passing, partially liquid drill core 12 that, following passage through the cooling zone 4, the drill core 12 is solidified. This occurrence is illustrated in FIG. 2, in that the liquid areas, shown as hatched parts in the lower part of the drill core, turn into semi-solid or pebbly areas, shown as granular and lined regions toward the upper part of the drill core. A complete solidification of the drill core 12 is indicated by the completely granular regions in the upper part of the drill core. Thus, the cooling zone 4 solidifies and forms the drill core 12 with regard to its strength and dimension. Moreover, a tight seal for the melt is provided within the cooling zone 4 such that no melt can escape upwardly under the prevailing melt pressure.

In order to achieve a constant, high drill-advance speed, one has to operate with a fuel-pressure as high as possible for achieving the necessary melt drill pressure. In order to generate this melt drill pressure, a drill core column of, for example, 100 meters, is to be created and left in place. This drill core column, by its own weight, generates a counter pressure to the melt pressure of about 200 bar.

A drill-core support pipe 19 is provided for stabilizing this drill-core column. The drill-core support pipe 19 is connected via support segments with the inner wall surface of the pressure pipe strand. The inner diameter of the drill-core support pipe 19 is somewhat larger than the outer diameter of the drill-core column. Above the drill-core support pipe 19, the drill core is transported in sections by shearing. In addition to the drill core itself, the melt surrounding the pressure drill head is also solidified. Following solidification, this melt forms a borehole lagging or lining, which is smooth at the inside and which is completely bonded with the sidewall rock, such that an erection of a separate, artificial borehole lining becomes superfluous.

As can be seen in FIG. 2, the lowermost part of the pressure pipe strand with its outer steel pipe 5 and its inner steel pipe 6 is disposed above the cooling zone 4. The lines 7, 8 are disposed in the intermediate space between the steel pipes 5 and 6 and are held in position there with well-insulating clamping elements 17. The space 18 between the solidified drill core 12 and the inner steel pipe 6 of the pressure pipe strand remains free and has to receive the hoisting device (described in further detail below) for the drill core 12. The steel pipes 5, 6 and the pressure drill head 1 can, as illustrated, overlap each other somewhat and can interlock in order to achieve a connection between each other which is as much as possible stable against torsion forces, pressure forces, tensile forces, and shearing forces.

Figure 3:
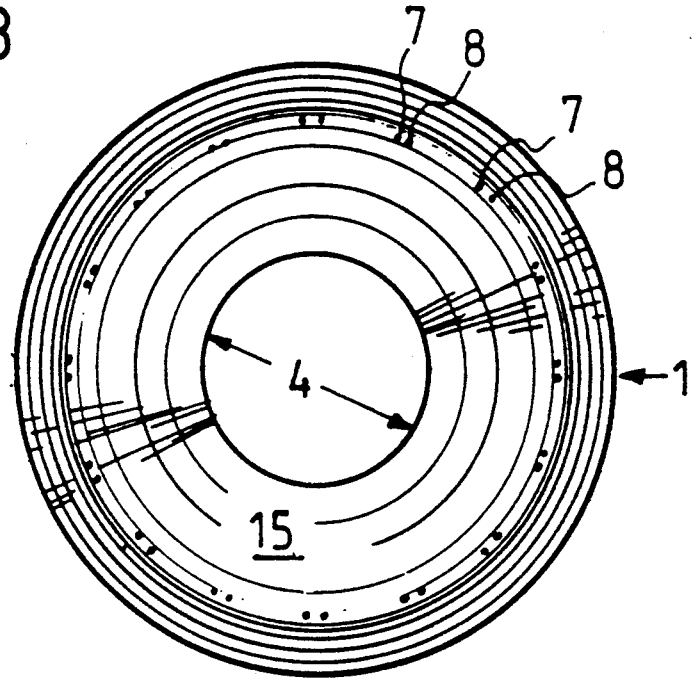
FIG. 3 is a view of a cross-sectional representation of the drill apparatus of FIG. 1 viewed from the bottom.

The drill apparatus as seen from below is shown in FIG. 3. A total of sixteen nozzles or, respectively, the discharge ports of the individual lines 7, 8, are distributed along the circumference of the drill head. The pressure pipe strand from the inner steel pipe 6 and the outer steel pipe 5 is connected at to the pressure drill head 1. The cooling zone 4 is shown in the inner region of the drill device, of which cooling zone only the wall, shaped as a funnel 15, is visible. The region within the cooling zone 4 remains free and serves for receiving the non-melted or only partially melted drill core pressed with melt Upon advancing of the drill apparatus, from time to time, the resulting drill core has to be sheared off and removed and transported upwardly. For example, if the drill apparatus has a diameter of 100 cm and a drill core having a diameter of 30 cm is left in place, then this means that, upon an advance of one meter, a drill core having a height of over 12 meters is generated.

Figure 4:
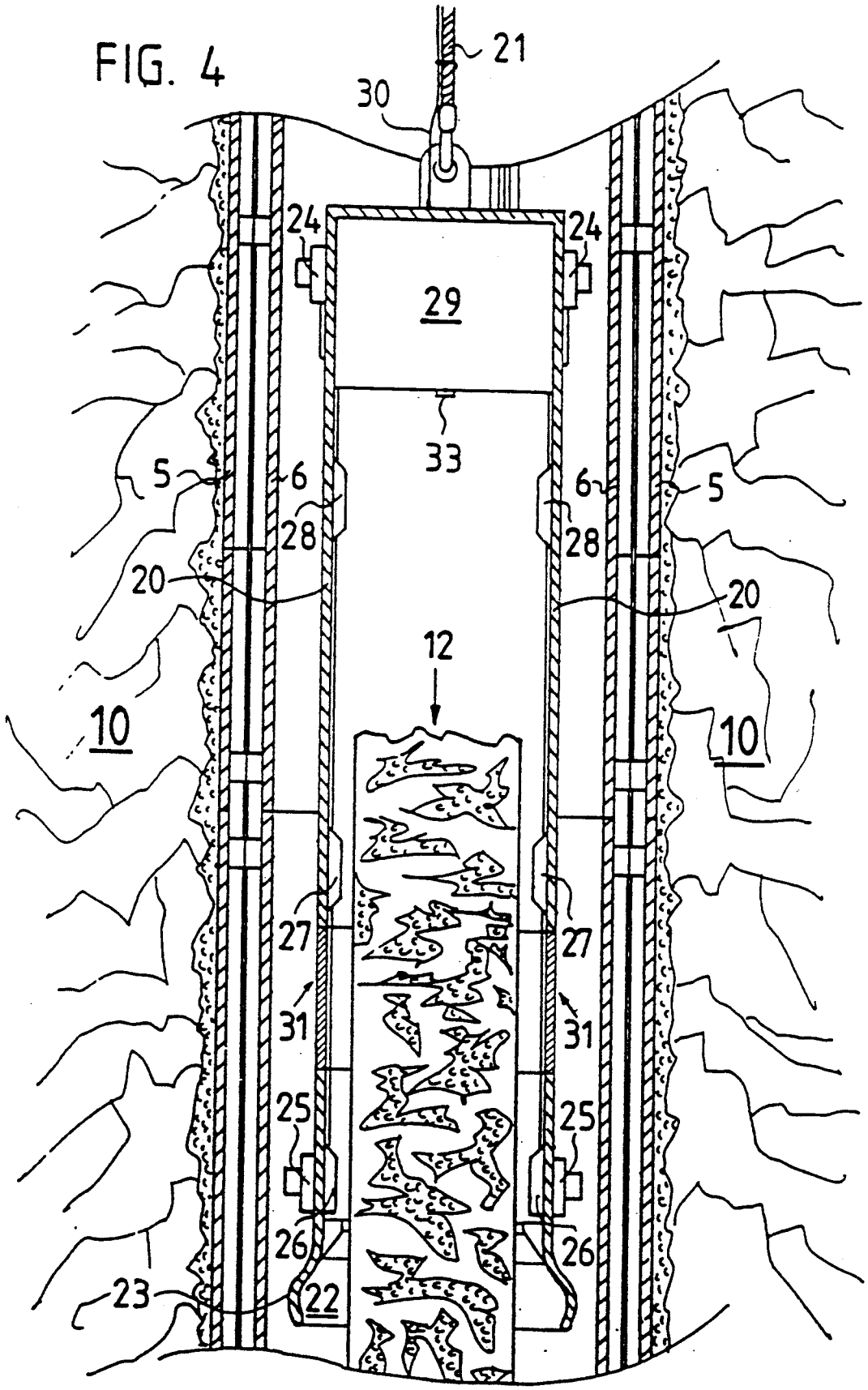
FIG. 4 is a view of a schematic representation of the drill- core hoisting device in the pressure-pipe strand above the drill apparatus in a longitudinal section along the borehole axis, at the moment when the drill-core hoisting device is clapped downwardly over the drill core.

An efficient drill-core hoisting device is necessary in order to remove and to transport away the resulting drill core lengths since the drill core is progressively developed at ever larger depths of several 1000 meters and is to be hoisted from there as fast as possible in order to preserve the continuous drill advance. Moreover, the drill core has to be sheared off first. An exemplified embodiment of such a hoisting device, disposed at the inside of the pressure pipe strand, is illustrated in a longitudinal sectional view in FIG. 4. FIG. 4 shows the moment in time where the hoisting device is clapped from above over the part of the drill core 12 to be hoisted and transported away. The inner steel pipe 6 and the outer steel pipe 5 of the pressure pipe strand can be seen as well as the fuel gas lines and cooling lines running in the intermediate space between these two steel pipes 5, 6. Further down and not visible, the drill core is surrounded by the support pipe 19 and extends, for example, approximately over 100 meter in said support pipe 19.

The hoisting device is made of a steel pipe 20. This steel pipe 20 exhibits a larger diameter than the drill core 12 which is left in place. This steel pipe 20 is formed in a way like a bell, i.e. it is open downwardly and exhibits there a funnel-shaped terminal section 22. This funnel-shaped terminal section 22 exhibits, on the one hand, a diameter as large as possible in order to facilitate the clamping of the pipe 20 over the drill core 12. On the other hand, the funnel-shaped terminal section 22 exhibits a rounded-off outer lower edge 23 in order to assure that this edge 23 does not get entangled anywhere at the pressure pipe strand during the advance motion of the hoisting device.

The upper part of the steel pipe 20 is closed and is suspended from a wire rope or from a carbon fiber rope 21, for example. In order to move the rope 21 quickly up and down without damage within the pressure pipe strand, wheels, not shown, can be disposed at its periphery which roll along on the inner side of the pressure pipe strand.

Several hydraulic or pneumatic piston cylinder units 24, 25 are mounted on the outer side of the pipe and distributed over the circumference near the lower and the upper end of the pipe 20. The pistons of these cylinder units 24, 25 move in a radial direction away from the pipe 20. Such hydraulic or pneumatic piston cylinder units 26, 27, 28 are mounted in like manner near the lower end of the drill head as well as distributed over the remaining inner side of the drill head. All these hydraulic or pneumatic piston cylinder units are fed by a hydraulic pump or a pneumatic pump, not illustrated. This pump is disposed in the region 29 of the upper part of the hoisting device. The corresponding hydraulic circuits or pneumatic circuits include control valves, which can be controlled via the control line 30 from aboveground.

The hoisting device is further equipped with several optical proximity and/or approach sensors, not shown. These sensors allow to control from aboveground the position of the hoisting device and of the drill core 12, clamped in the hoisting device following clapping.

The steel pipe 20 is interrupted by a flexibly constructed area 31 between the lowermost hydraulic units 25, 26 and the next higher level hydraulic units. This area 31 can for example be made of a multi-layer steel mesh or of a carbon fiber ply compound material such that the area is bendable and easily expandable while at the same time being able to withstand large tensile forces. The function of this flexible area 31 will become even more evident from the description of the operating method of the hoisting device.

Figure 5:
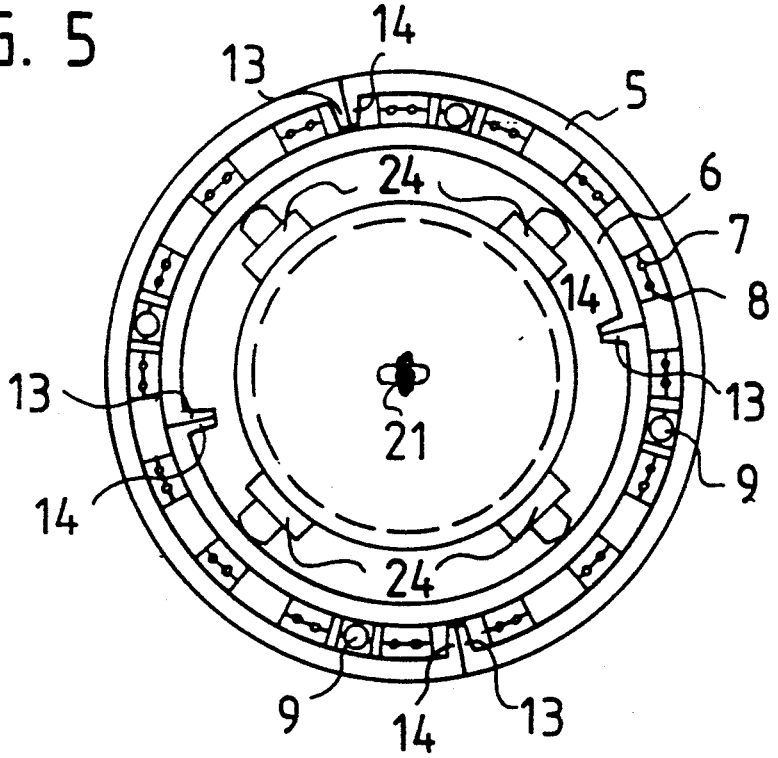
FIG. 5 is a cross-sectional view onto the pressure pipe strand, as well as onto the drill-core hoisting device suspended in the pressure-pipe strand.

FIG. 5 illustrates a top view onto the hoisting device in the pressure pipe strand. The pressure pipe strand is represented in a cross-section. The outer steel pipe 5 and the inner steel pipe 6 can be recognized. The steel pipes 5, 6 are each made of two half-shells. During the course of the drilling, these two half-shells are assembled around the continuously advancing lines 7, 8, 9. Employing an industrial adhesive is a preferred adhesion method. The half-shells exhibits along their longitudinal edges extensions 13, 14, which form good adhesion surfaces. The extensions 13, 14 at the half-shells of the outer steel pipe 5 form simultaneously connection webs to the inner steel pipe 6. The lines 7, 8 for the hydrogen and the oxygen as well as the cooling lines are disposed in the intermediate space between the two steel pipes 5, 6. Well-insulating clamping elements 17 are disposed at the outer side of the inner steel pipe 6 or, respectively, at the inner side of the outer steel pipe 5. The lines 7, 8, 9 are placed like in a casing clamp in between the clamping elements 17 and are secured by said clamping elements 17.

The drill-core hoisting device is suspended with a carbon fiber rope 21 of low weight proper at the inside of the thus formed pressure pipe strand. A top view of the drill-core hoisting device can be seen in FIG. 5. Four hydraulic or pneumatic piston cylinder units 24 are distributed over the circumference in the upper part of the drill-core hoisting device. These piston cylinder units 24 serve for a shearing off of the drill core, as described in more detail below.

FIG. 4 shows how the hoisting device, with throughout retracted pistons at the piston cylinder unit 24–28, is clapped over the drill core 12 to be removed and transported away. A centering function is achieved by means of a special construction of a lower edge collar 23 such that the steel pipe 20 can be moved with certainty over the drill core 12.

Figure 6:
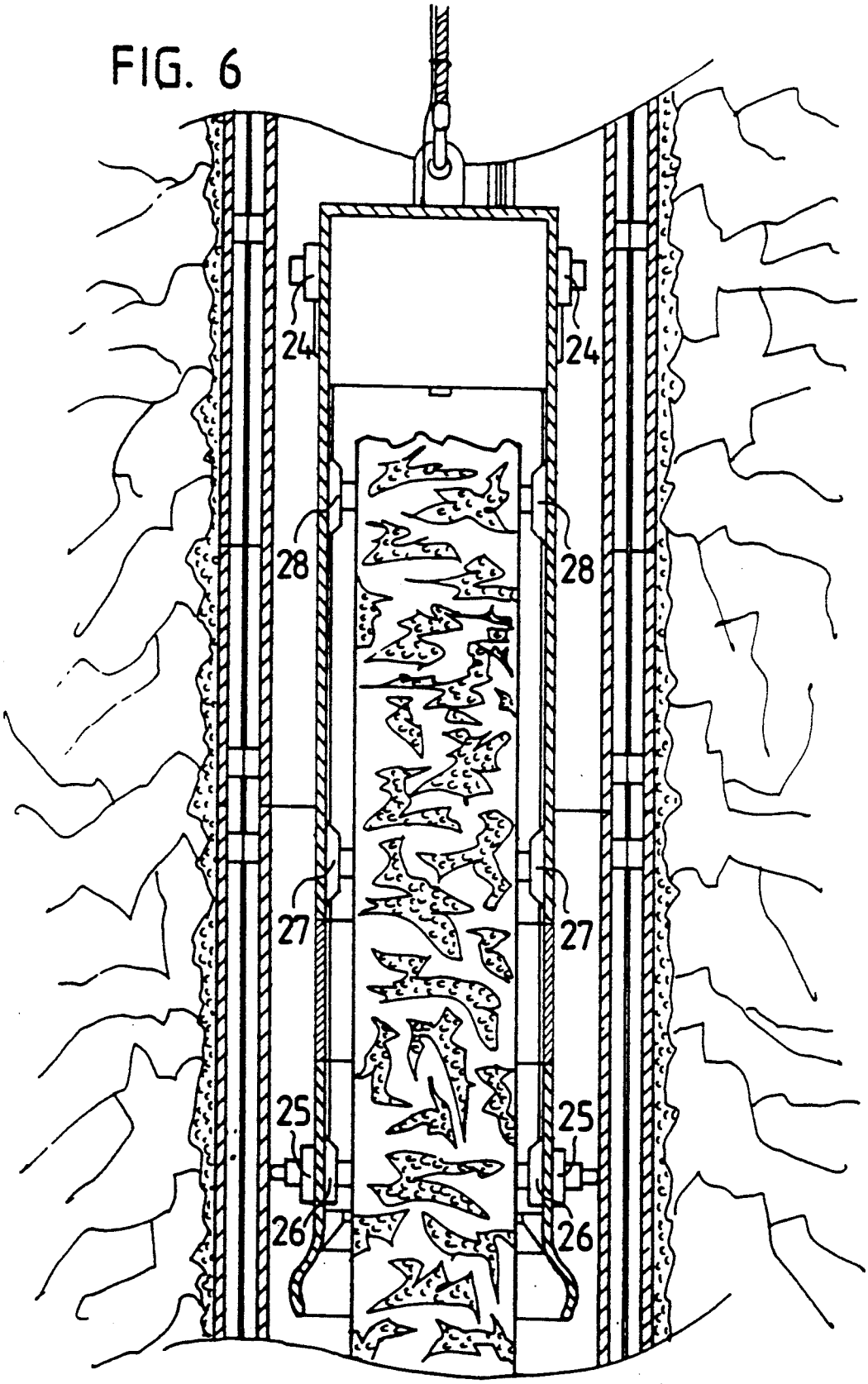
FIG. 6 is a schematic representation of the drill-core hoisting device following clamping of the drill core.

A proximity switch 33, disposed below the region 29 inside the upper end of pipe 20, generates a signal when the clapping process is to be terminated. The corresponding signal gently stops the downward motion of the hoisting device. Subsequently, all piston cylinder units 25–29, with the exception of the uppermost piston cylinder unit 24, are put under pressure such that the drill core is fixedly clamped or fixedly clawed in the hoisting device. Furthermore, the steel pipe 20 itself is also clamped at the lower end by means of the piston cylinder unit 25 opposite to the inner steel pipe 6 of the pressure pipe strand. The starting position for the shearing off of the drill core is thereby reached, as is shown in FIG. 6.

The shearing off occurs in that one of the piston cylinder units 24 at the upper end of the hoisting device is actuated. A shearing force is thereby exerted onto the drill core 12 such that the drill core breaks without fail in the area 31, where the hoisting device is of a flexible construction and can give. A rock mass cracks already at a torque of less than 100 bar such that, with a length of several meters of the drill core to be broken off, there is generated such a considerable lever action that the operating pressure of the piston cylinder unit 24 can remain in the region of a few bar.

Figure 7:
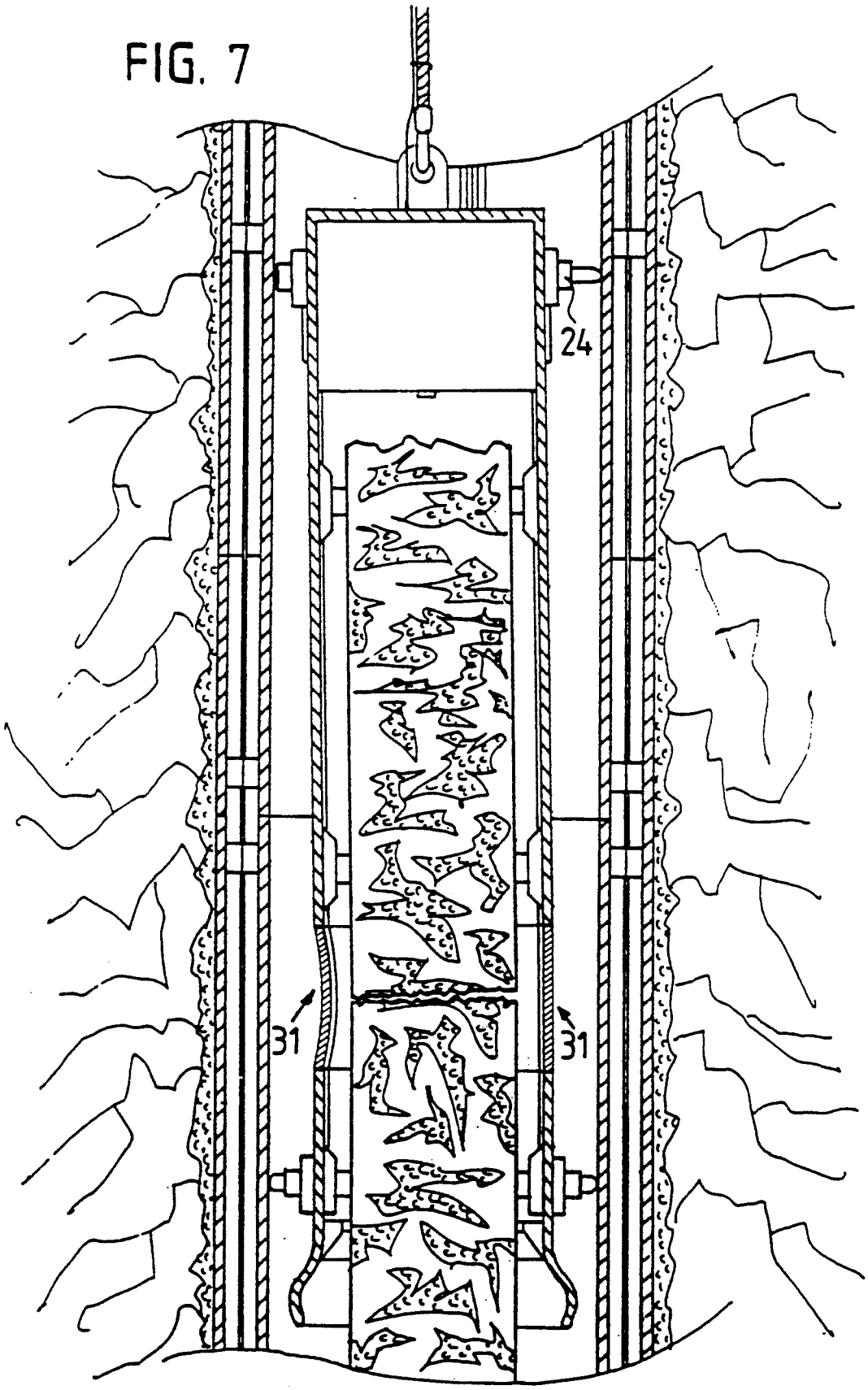
FIG. 7 is a schematic representation of the drill-core hoisting device immediately following shearing off of the drill core.
Figure 8:
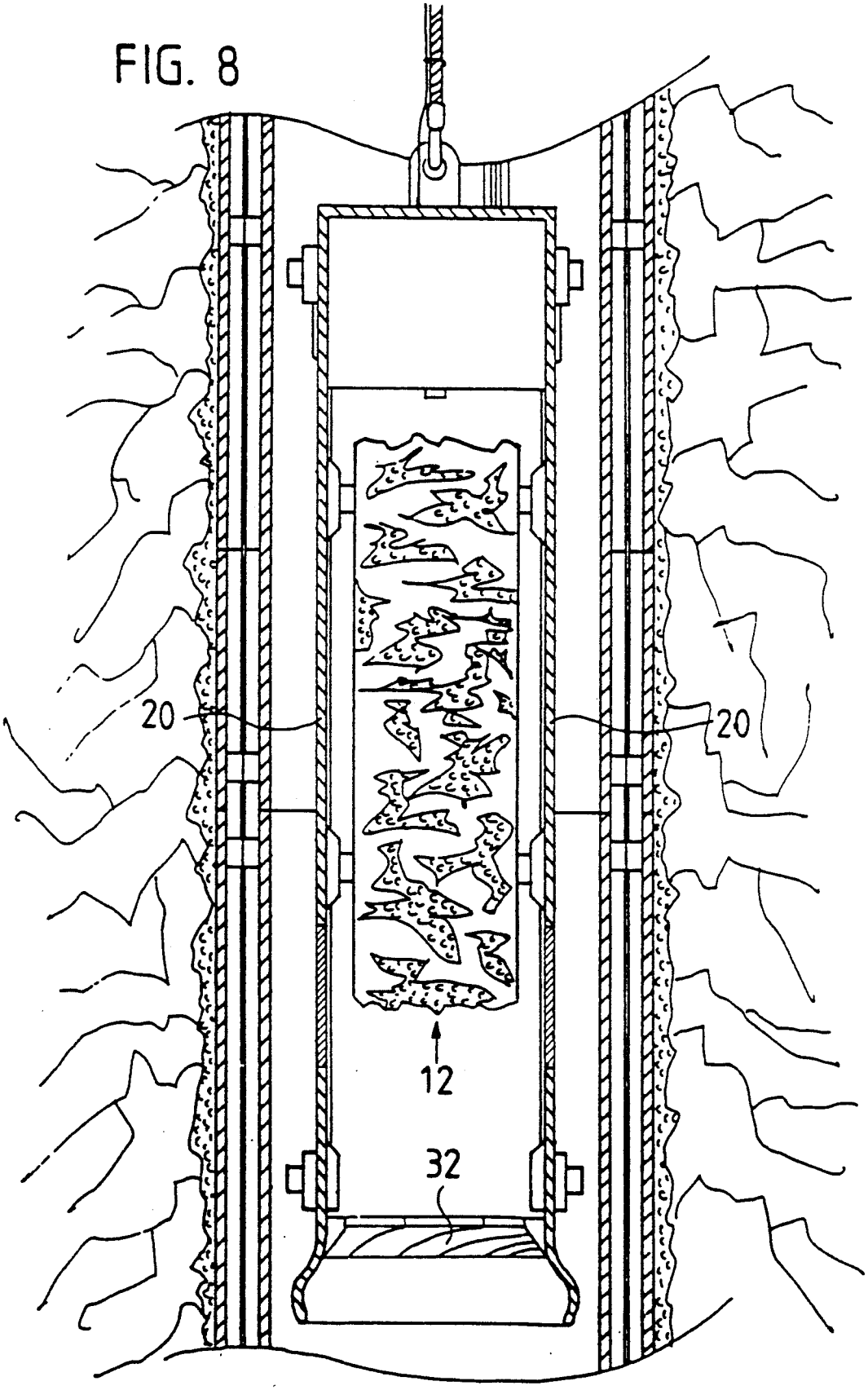
FIG. 8 is a schematic representation of the drill-core hoisting device at the time of lifting up of the drill core in the interior of the pressure-pipe strand.

FIG. 7 shows the hoisting device immediately following the shearing off. The point of fracture can be recognized within the flexible area 31. The hoisting device is now again returned into the central position in the pressure pipe strand by retracting the piston of the piston cylinder unit 24. The pistons of the piston cylinder units 25 and 26 are also retracted such that the hoisting device with the sheared off drill core part is freely suspended in the pressure pipe strand. The situation, where the hoisting device with the sheared off drill core 12 is pulled upwardly, is illustrated in FIG. 8. The lower opening of the hoisting device can be provided with an annular diaphragm 32 which, similar to the diaphragm of a camera lens, closes the steel pipe 20 during the hoisting operation such that no rock pieces released by the drill core can fall down into the borehole and impair or even render impossible the clamping of the hoisting device in the next cycle. This lens closure can for example be pneumatically actuated or by hydrostatic or hydraulic means, not shown. Prior to closure and to lifting off of the drill core column left in place, generated broken parts are blown by means of compressed air into catch pockets, not shown, above the lens closure.

The invention method can not only be applied for vertically running boreholes but also for boreholes where the drill advance directions are deviating from a vertical direction. The invention method is particularly suited for construction of deep shafts running in a downward transverse direction as well as for construction of tunnels and shafts having oversized diameters running in any possible angular directions, particularly also in a horizontal directions. In case of a horizontal direction, the pressing of the melt mainly into the remaining drill core has different reasons than in case of deep drillings. In case of horizontal or near-horizontal bores, as well as in case of upwardly sloping bores, the shearing forces in the sidewall rock do not particularly increase, unless a tunnel is being built through a mountain, in which case there also occur high overburden pressures. Apart from that, however, the melt is in this case primarily pressed into a remaining drill core, since the melting and grouting of the entire borehole diameter would consume an economically unacceptable amount of energy and since, moreover, such a melting and grouting could hardly be realized due to process-technological considerations.

The drill core is led through a cooling zone where it is brought to solidification via similar way as is done in deep drill processes, in case of such shallow drilling having very large diameters, such as for example for the construction of train or road tunnels. Subsequently, the solidified drill core is carried in a conductor pipe instead of merely being held by a support pipe. The lower inner surface of the conductor pipe is furnished with slide rollers. The transport of the drill core column up to the end of the melt drill apparatus occurs via the conductor pipe with an hydraulic system advance and a support hydraulic system of the melt drill apparatus. There, the drill core is blasted off and the material thereof is transported on rail vehicles out of the tunnel. The drill device includes an automatically advancing pressure hydraulic system which acts as support for the advance hydraulic system. The advance hydraulic system is radially braced between the borehole wall and the drill-core conductor pipe. The advance hydraulic system, supported at the automatically advancing pressure hydraulic system, serves to maintain at all times the required melt pressure ahead of the drill head.

Calculations have shown that the invention melting drill technique increases the drill advance speed by a power of ten in comparison with conventional deep drilling methods. Drilling time and drilling costs are correspondingly reduced.

According to the profile melting-drill method of the present invention and based on the continuous removal of the overburden pressure from the drill core region, there results an improvement and easing of the pressing out of the resulting fused rock mass with increasing depth. The drill core, subjected to pressure, cracks as soon as the profile melting-drill apparatus melts the borehole profile around the drill core out of the rock formation based on the increasing overburden pressure with increasing depth and the thereby increasing internal rock pressure at the foot of the drill core. The drill core is thereby released from the outer counter pressure generated by the combustion gases.

Based on the flow-off of the molten rock mass subjected to the melting-drill pressure in the borehole, which is opened up by way of pressure release through the removal tube, the fused rock mass experiences an increase and densification and compaction of the volume or a volume increase based on the amount of the fused rock mass absorbed from the molten-out borehole profile. This provides an additional upward push to the drill core relative to the cooling zone of the internal melting-drill apparatus.

The drill core section, cracked by the release of the internal rock pressure, is filled up by the melt from the borehole profile and the melt material is solidified again after passage of the inner cooling zone of the profile melting-drill apparatus. Then, the drill core is removed in sections by shearing.

As described in detail above, the pressing in of the molten rock obtained is made even easier as the depth increases in accordance with the invention process because of a constant reduction of the overburden pressure in the drill core area. Due to the increasing internal rock pressure at the bottom of the drill core, the latter bursts as soon as the heat drilling equipment melts the profile around the drill core out of the rock stratum and thus releases the drill core from external counter-pressure. The flow of the molten rock, pressed by the melting pressure into the now cracked drill core, causes that either the core volume is compacted, or that the core volume is increased by the amount of molten rock absorbed from the outer borehole profile or results in a corresponding uplift.

The process in accordance with the invention can be executed in such a way that the drill core is sheared off and automatically extracted in a definite distance after the drill core has passed through a cooling zone.

A hydrogen-oxygen jet, laser beams, ionized gas plasma beams, electric arcs, and electron beams may be considered in particular as a heat source for the execution of the invention process. Essential is a parabolic crown shape for the heating zone.

Thus, in the application of the heat drilling process in accordance with the invention, an exterior borehole profile, which is as narrow as possible, is melted out, while a drill core, which is as large as possible, remains.

The present profile melting-drill method can also be applied in depths, where the shearing forces of the sidewall rock become larger based on the increasing overburden pressure, than the technically feasible and generatable pressure for maintaining of the "Litho-Frac" process according to German Patent DE-PS-2,554,101, where the sidewall rock is cracked and where the excess melt is pressed out into the generated cracked spaces. The profile melting-drill method of this invention can also be applied in places where the conventional melting-drill method of the German Patent DE-OS-2,554,101 comes to a halt because of existing overburden pressures which cannot be overcome.

The profile melting-drill method is also available for tunnel and shaft constructions with an over-large borehole diameter, where it is not necessary to drill open the full borehole cross-section, and thus melting energy can be saved and valuable construction material can be obtained in the form of compact drill core segments.

The profile melting-drill method can also be employed and operated at constant pressures in the context of large-depth drilling, in spite of the tremendously increasing overburden pressure in the sidewall rock. This means that the drilling time is decreased because of minimization of interference situations and a cost reduction is achieved in the plant construction and therefore the operating costs of the enterprise are reduced.

An essential innovation of the melting-drill method consists in that the rock is no longer broken up mechanically but rather it is fused by a hydrogen/oxygen-jet of 3.500° C. with combustion products as well as resulting fused rock mass being used together as working media and raw materials in the drilling technique. This enables continuous drill advancement. Once the solidified fused mass in the cooling zone area above the melting-drill head has formed a pressure lock, a pressure builds up in the fused mass as the peripheral drill apparatus advances. If the pressure in the fused mass exceeds the shearing forces of the sidewall rock, then the rock breaks apart, whereby the "well cuttings" present as fused mass are pressed into the cracks created in the sidewall rock and solidify into a rigid borehole lining or into the borehole core, respectively. In this way, with continuous drill advance, a rigid borehole lining is produced from the resulting fused mass generating a high pressure bond in and on the sidewall rock. The side wall rock then acts as a drill guide for the peripheral or outer edge drill apparatus.

Because of the melting-drill procedure, the profile of the borehole or tunnel may be chosen at will. This is particularly significant in tunnel construction and means additional cost savings.

The combustion product of hydrogen and oxygen in the form of water vapor lowers the fusion point in the rock fusion process and thereby saves energy costs. The water vapor is absorbed into the fused rock mass and removed together with the fused rock mass.

The peripheral drill apparatus is cooled from within by water and the fuel gas itself since both water and hydrogen have a great heat capacity. This increases the service life of the high temperature jet-pressure head and enables it to withstand the corrosion effect of the hot fused rock mass until reaching target depth. In this way, it is possible to drill continuously in any substratum, even with a large borehole diameter, at a high drill advance speed, with any desired borehole cross-section, and in any chosen drilling plane, while producing simultaneously a stable borehole lining from the resulting fused mass.

Experimental evidence has proved the resistance of the invention melting-drill head material to the high fusion temperature, the ability of the jet stream to withstand the built-up fused rock mass pressure, and the effectiveness of the invention melt device in piercing the rock, while simultaneously building up a borehole lining out of fusion drillings and removing the majority of the surplus melt through the drill core.

The invention melting-drill method itself is a technology which can be operated cleanly and simply and which greatly benefits society. The application possibilities, especially the geothermal resource extractable decentrally anywhere, and its direct form of exploitation for heating purposes and energy production in the form of superheated water, will put every country into a position of covering its own energy and heat requirements at internationally comparable costs and of installing new environmentally-protective production processes which were prevented up to now through high energy costs.

Global use of earth's heat via the invention melting-drill technique, including the "Hot-Dry-Rock" method eliminates the principal cause of the presently looming environmental and climatic catastrophe, i.e. the combustion of hydrocarbons for energy production and their resulting harmful combustion products.

New high-speed transportation systems in low pressure tunnels with top speeds of 800 km/h, driven by gravity and atmospheric pressure, can be realized with the help of the invention profile melting-drill technique. This would allow long-distance traffic and a majority of passenger traffic or rail traffic to travel underground, particularly in congested areas. Mobility of labor would increase enormously. Places of work some hundreds of kilometers distant would then be just as accessible as those places which are today at a 20-km distance during rush-hour by car. Such an environmentally-friendly and fast means of travel would greatly boost economic market integration and the exchange of goods in general.

Another application of invention technology, in the creation of permanent, safe storage for long-life, highly radioactive waste, for which safe disposal for thousands of years becomes more pressing with each nuclear power plant closure, shows for the first time a practicable way to dispose of these long-life waste products produced by nuclear fission.

For the first time since the beginning of the industrial age, profile melting drill technology in its entire scope of applications for future industrial developments opens up a forgiving harmony between nature and technology, and in particular brings underdeveloped countries the possibility to develop their economies with environmentally-protective and appropriate techniques, and of coming to grips with the population explosion in their countries without devastating famines.

The invention method is useful in super deep wells and large-diameter deep wells as such as tunnel bores, where energy saving is an important factor. Of innovative significance in tunnelling is also the fact that the profile of the melting-drill head may be matched to the desired tunnel shape, thus saving on expensive tumel walling.

The lithosphere is opened up to human beings as a new production area with the peripheral drill apparatus as melting-drill device, just as rocket propulsion opened up the way to the space.

It will be understood that each of the elements described above, or two or more together, may also find a useful application in other types drilling methods differing from the types described above.

While the invention has been illustrated and described as embodied in the context of a profile melting-drill process, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A melting-drill process for tunnel drillings, deep-drillings, and exploratory drillings comprising detaching a drill core from its rock formation mass under cracking and ripping caused by thermal stresses;

melting only a profile of a borehole to be drilled; pressing the resulting melt substantially into the drill core;

subsequently solidifying the drill core by cooling; shearing off of the drill core; and removing the drill core in sections, whereby a pressure decrease is achieved in drillings and wherein said pressure decrease allows a limiting of the required melt pressure in the drilled hole.

2. The melting-drill process according to claim 1, further comprising drilling to depths, where an overburden pressure in sidewall rock exceeds technically controllable melt pressures such that the melt can no longer be pressed into the sidewall rock, and wherein the drilling is performed for shaft and tunnel drillings which run in a vertical direction, and where oversized diameters do not allow a removal of a drill core melt due to energy and process-technical reasons.

3. The melting-drill process according to claim 1, further comprising using the weight proper of the drill core for a generation of a counter pressure relative to the melt pressure;

keeping the drill core at a roughly permanent height level by a continuous shearing off and removal of the drill core, wherein the roughly permanent height level of the drill core allows a drill advance under a roughly constant melt pressure.

4. A process according to claim 1, wherein the melting is performed by at least one high-temperature source supplied by a stoichiometric combustion of hydrogen and oxygen.

5. A process according to claim 1, wherein the melting is performed by at least one high-temperature source supplied by laser canons.

6. A process according to claim 1, wherein the melting is performed by at least one high-temperature source supplied by ionized plasma rays.

7. A process according to claim 1, wherein the melting is performed by at least one high-temperature source supplied by electron gun beams.

8. A process according to claim 1, wherein the melting is performed by at least one high-temperature source supplied by an electric arc.

9. A melting-drill process for tunnel drillings, deep-drillings, and exploratory drillings to drill depths where the overburden pressure in the sidewall rock exceeds the technically controllable melt pressures such that the melt can no longer be pressed into the sidewall rock, or for shaft and tunnel drillings which run in a vertical direction, where oversized diameters do not allow a removal displacement of the total drill core melt due to energy and process-technical reasons, comprising melting only an outer circular profile of the borehole to be drilled pressing the resulting melt primarily into the drill core, which has been detached from its rock mass and is therefore cracked and ripped by thermostress, subsequently solidifying the drill core by cooling, and shearing off and removing the drill core in sections, whereby a pressure decrease is achieved in shaft drillings and deep-drillings, where said pressure decrease allows a limiting of the required melt pressure.

10. The melting-drill process according to claim 9, further comprising using the weight of the drill core itself for a generation of a pressure counter to the melt pressure in that the drill core is left in place at a nearly permanent height level due to a continuous shearing off and removal, and advancing the nearly permanent height level of the drill core under a nearly constant melt pressure.

11. A process according to claim 9, further comprising performing the melting by at least one high-temperature source supplied by a stoichiometric combustion of hydrogen and oxygen.

12. A process according to claim 9, further comprising performing the melting by at least one high-temperature source supplied by laser canons.

13. A process according to claim 9, further comprising performing the melting by at least one high-temperature source supplied by ionized plasma rays.

14. A process according to claim 9, further comprising performing the melting by at least one high-temperature source supplied by electron gun beams.

15. A process according to claim 9, further comprising performing the melting by at least one high-temperature source supplied by an electric arc.

16. A device for executing a melting-drill process for tunnel drillings, deep-drillings, and exploratory drillings, wherein the device comprises a hollow-cylindrical pressure pipe strand;

a hollow-cylindrical pressure drill head for melt drilling attached to the hollow-cylindrical pressure pipe strand;

wherein a space in the center of the pressure drill head and of the pressure pipe strand is left empty in direction of drilling;

a fuel line for liquid oxygen;

a fuel line for liquid hydrogen;

nozzles disposed on a periphery of the pressure drill head and connected to the fuel line for liquid oxygen and to the fuel line for liquid hydrogen.

17. The device according to claim 16, further comprising several heat sources distributed over the circumference of the hollow-cylindrical pressure drill head, where said heat sources generate the melt heat;

a tubular cooling zone including a wall;

a cooling agent;

wherein the hollow-cylindrical pressure drill head tapers in an upward direction at its inner side and wherein the hollow-cylindrical pressure drill head opens into the tubular cooling zone, where the cooling agent flows through the wall of the cooling zone.

18. The device according to claim 17, further comprising a steel pipe having a slightly larger inner diameter than the cooling zone and following the cooling zone of the hollow-cylindrical pressure drill head, wherein the steel pipe is to act as support pipe over the height of a retained drill core column.

19. The device according to claim 16, further comprising two steel pipes disposed concentrically with respect to each other, wherein the two steel pipes are each assembled by at least two shells;

a cooling line for a cooling medium;

wherein the two steel pipes form the pressure pipe strand, and wherein the fuel lines and cooling line are guided in an intermediate space between the two steel pipes.

20. The device according to claim 19, further comprising a drill-core hoisting device suspended in the interior of the pressure pipe strand, wherein the drill-core hoisting device is formed as a bell which can be clapped over a remaining drill core, and wherein the bell-shaped drill-core hoisting device includes a lower part and an upper part;

means for clamping and shearing off of a drill core disposed at the drill core hoisting device.

21. The device according to claim 20, wherein the means for clamping and shearing off of the drill core is furnished by hydraulic piston cylinder units.

22. The device according to claim 20, wherein the means for clamping and shearing off of the drill core is furnished by pneumatic piston cylinder units.

23. The device according to claim 20, wherein the lower part of the bell-shaped drill-core hoisting device is formed flexible such that the upper part of the bell-shaped drill-core hoisting device is tilted in relation to said lower part of the bell-shaped drill-core hoisting device.

24. The device according to claim 23, further comprising a closure means disposed at the lower part of the bell-shaped hoisting device, wherein said closure means closes off the lower part of the bell-shaped hoisting device.

25. The device according to claim 24, further comprising catch pockets disposed above the closure means of the hoisting device;

conveying means;

wherein rocks, broken off during the shearing off, are transported with the conveying means into the catch pockets by means of compressed air.

26. A device for executing a melting-drill process for tunnel drillings, deep-drillings, and exploratory drillings, wherein the device comprises a hollow-cylindrical pressure drill head for melt drilling and a hollow-cylindrical pressure pipe strand, wherein a space in the center of the pressure drill head and of the pressure pipe strand is left empty in direction of drilling;

several heat sources distributed over the circumference of the hollow-cylindrical pressure drill head, where said heat sources generate a melt heat, wherein the hollow-cylindrical pressure drill head is upwardly tapered at its inner side and opens into a tubular cooling zone, wherein a cooling agent can flow through a wall of the cooling zone;

a steel pipe of a slightly larger inner diameter than the cooling zone following the cooling zone of the hollow-cylindrical pressure drill head; wherein the steel pipe forms a support pipe over the height of a remaining drill core column;

wherein the pressure pipe strand is comprised of two steel pipes, disposed concentrically with respect to each other, wherein the two steel pipes are each assembled by at least two shells, and wherein lines for a supply of fuel gas and cooling agent are guided in an intermediate space between the two steel pipes;

a drill-core hoisting device suspended in the interior of the pressure pipe strand, wherein the drill-core hoisting device is formed as a bell which can be clapped over the remaining drill core, and wherein the drill-core hoisting device includes means for a clamping and shearing off of the drill core.

27. The device according to claim 26, wherein the means for clamping and shearing off of the drill core is disposed at the drill-core hoisting device and is furnished by hydraulic or pneumatic piston cylinder units.

28. The device according to claim 26, wherein a lower part of the bell of the drill-core hoisting device is formed flexible such that the upper part of the bell can be tilted in relation to the lower part of the bell;

wherein the lower part of the bell of the hoisting device can be closed off by means of a diaphragm;

wherein catch pockets are disposed above the diaphragm of the bell, and wherein means are provided for a transporting of broken rocks, produced during the shearing off, into the catch pockets by means of compressed air.

* * * * *